United States Patent [19]

Kuk et al.

[11] Patent Number: 4,483,763

[45] Date of Patent: Nov. 20, 1984

[54] REMOVAL OF NITROGEN FROM A SYNTHETIC HYDROCARBON OIL

[75] Inventors: Myong S. Kuk; Edgar W. Albaugh, both of Monroeville; John C. Montagna, O'Hara Township, Allegheny County, all of Pa.

[73] Assignee: Gulf Research & Development Company, Pittsburgh, Pa.

[21] Appl. No.: 453,715

[22] Filed: Dec. 27, 1982

[51] Int. Cl.[3] ..... C10G 67/04; C10G 67/08

[52] U.S. Cl. ..... 208/254 H; 208/254 R

[58] Field of Search ..... 208/254 H, 254 R, 212, 208/325, 326, 327

[56] References Cited

U.S. PATENT DOCUMENTS

| | | | |
|---|---|---|---|
| 2,035,583 | 3/1936 | Bailey | 546/181 |
| 2,035,584 | 3/1936 | Bailey | 546/181 |
| 2,541,458 | 2/1951 | Berg | 208/254 R |
| 2,916,497 | 12/1959 | Murray, Jr. et al. | 208/325 |
| 3,719,587 | 3/1973 | Karchmer et al. | 208/208 R |
| 3,864,245 | 2/1975 | Van Tassell | 208/321 |
| 4,159,940 | 7/1979 | Smith | 208/254 H |
| 4,209,385 | 6/1980 | Stover | 208/254 R |
| 4,261,813 | 4/1981 | Smith | 208/254 H |
| 4,268,378 | 5/1981 | Compton | 208/254 R |
| 4,271,009 | 6/1981 | Stover et al. | 208/254 R |

*Primary Examiner*—Delbert E. Gantz
*Assistant Examiner*—O. Chaudhuri
*Attorney, Agent, or Firm*—Deane E. Keith; Forrest D. Stine

[57] ABSTRACT

Nitrogenous compounds are eliminated from a synthetic hydrocarbon oil such as shale oil by partial hydrogenation followed by solvent extraction using a three-component solvent comprising an organic polar solvent, an acid and water. For example, a furfuryl alcohol, hydrochloric acid and water solution will remove the major quantity of the nitrogen compounds from shale oil which remain following the partial hydrogenation of the shale oil.

10 Claims, No Drawings

REMOVAL OF NITROGEN FROM A SYNTHETIC HYDROCARBON OIL

SUMMARY OF THE INVENTION

Nitrogen is removed from a synthetic hydrocarbon oil such as shale oil in a two-stage procedure. In the first stage, mild hydrogenation eliminates a substantial portion of the nitrogen from the oil. In the second stage, a liquid-liquid extraction procedure using a substantially immiscible, multi-component liquid extractant comprising an organic polar solvent, a mineral or organic acid and water in suitable proportions removes the remaining, more intractible nitrogen compounds.

DESCRIPTION OF THE INVENTION

The kerogen in oil shale, such as the shale comprising the Green River formation in the western United States, has been thermally extracted on a relatively small scale by various retorting procedures. Thermal retorting, whether in situ or ex situ, is also predicted by many to be the primary method which will be used in future large-scale recovery operations, notwithstanding the fact that other methods, such as solvent recovery, are under serious consideration. Since this extracted shale oil contains a variety of undesirable components, it must be subjected to a refinery operation to eliminate certain undesirable substances from the crude mixture and to convert less desirable structures to more desirable forms by altering chemical structures by means of cracking, reforming, and related catalytic procedures.

Shale oil contains a relatively high proportion of heterocyclic, nitrogenous impurities which interfere with the catalysts used in the various refining procedures in a way similar to the poisoning effect of nitrogen compounds in petroleum on the various catalysts utilized in petroleum refining. These nitrogen compounds must be removed from the crude shale oil prior to refining, and in particular, prior to any catalytic treatment of the shale oil to protect the catalysts from nitrogen poisoning. Some of those nitrogenous impurities which are not successfully removed in the refinery operations will poison the catalysts, and the remainder will be carried over into the final product. These nitrogenous contaminants will introduce instabilities into the various product fractions, as evidenced by sludge formation, deposits, and the like, all of which interfere with the intended use of the different products.

These nitrogenous impurities can be successfully eliminated from the shale oil by rigorous hydrogenation, but hydrogenation is much too costly due to the large content of nitrogenous material in the shale oil and the difficulty in hydrogenating some of the nitrogen compounds. Alternative purification procedures for removing nitrogen from shale oil have been proposed, but none have been found that are both economical and effect the complete removal of the nitrogen down to a few parts per million.

We have discovered that the nitrogenous impurities in shale oil can be effectively removed from the shale oil by a two-stage denitrogenation procedure. In the first state, relatively mild hydrogenation eliminates nitrogen from a substantial proportion of the easy-to-hydrogenate nitrogen compounds. In the second stage, a liquid-liquid extraction procedure utilizing a multi-component liquid extractant removes the remaining nitrogen compounds, the more difficult-to-hydrogenate nitrogen compounds. Our two-stage, hydrogenation-extraction procedure is able to produce a higher quality shale oil product containing less nitrogen and having lower gum forming tendency and at lower cost than can be obtained solely by hydrogenation.

The extractant liquid used in our process comprises an organic solvent, a mineral or organic acid, and optionally, but preferably, water, in particular proportions for maximum effectiveness. In the purification procedure, the extraction liquid is brought into intimate contact with the shale oil either in a batch or a continuous countercurrent extractor for the extraction of the nitrogen compounds from the oil. The nitrogen compounds which are present in shale oil and which are removed by our process can be typed as basic, which includes weakly basic, and non-basic nitrogen compounds. The basic nitrogen compounds include various pyridines, alkylquinolines, alkylacrilines, hydroquinolines, hydroxypyridines, and the like. The non-basic nitrogenous constituents include pyrroles, indoles, carbazoles, and their various alkyl-substituted analogs.

The organic polar solvent comprising our extractant solution can be an aliphatic alcohol having from one to about five carbon atoms, such as methanol, ethanol, isopropyl alcohol, 1-butanol, and the like; an aliphatic ketone having from three to about six carbon atoms such as acetone, methylethyl ketone, and the like; aliphatic polyols such as ethylene glycol, polyethylene glycols having from four to about twelve carbon atoms, glycerine, and the like; aliphatic esters of monocarboxylic acids having from two to about six carbon atoms such as ethyl acetate, propyl formate, and the like; aliphatic amides having from one to about four carbon atoms such as formamide, acetamide, dimethyl acetamide, and the like; five-member heterocyclic ring compunds having from three to about eight carbon atoms and optionally including one or more lower alkyl, carbonyl, formyl, lower alkoxy, and the like groups such as $\gamma$-butyrolactone, furfuryl alcohol, furfural, ethylene carbonate, tetramethylene sulfoxide, sulfolane, 2-pyrrolidone, N-lower alkyl-2-pyrrolidones, and the like; dimethyl sulfoxide, diethyl sulfoxide, and the like.

The acid used in our extractant solution can be a mineral acid such as hydrochloric acid, hypochlorous acid, sulfuric acid, sulfurous acid, nitric acid, phosphoric acid, phosphorous acid, and the like. The organic acid is a carboxylic acid, preferably a lower molecular weight carboxylic acid such as formic acid, acetic acid, propionic acid, butyric acid, and the like; however, higher molecular weight carboxylic acids having as many as eighteen carbon atoms per molecule such as stearic acid, oleic acid, and the like, are useful. Also useful are dibasic carboxylic acids such as oxalic acid, malonic acid, succinic acid, adipic acid, and the like. The mineral and carboxylic acids are generally utilized as an aqueous solution.

The organic polar solvent is the major component in the extractant solution. It comprises at least about 50 weight percent, preferably at least about 70 weight percent of the extraction solution. The mineral or carboxylic acid comprises between about 0.5 and about 15 weight percent, preferably between about 1 and about 10 weight percent of the extractant solution. Although the presence of water in the extractant solution is not critical it is desirable that is be present, particularly to reduce shale oil solvency in the polar solvent. The amount of water can be conveniently expressed in relation to the acid since the acids are generally produced and used as aqueous solutions. That is, the acid can broadly range from anhydrous to about 90 weight percent water, but preferably the acid used in making our solution will contain from about 10 to about 50 weight percent water. This can be expressed as a weight ratio of water to acid of up to about 10:1, and preferably a weight ratio of water to acid of between about 1:10 and about 1:1.

The temperature at which the extraction is carried out is not critical, provided that the partially hydrogenated shale oil is warm enough to be fluid, which will generally be a temperature from about 50° to about 100° F., depending on the particular composition of the oil. The maximum temperature used in the extraction procedure is restricted to about 250° to about 300° F. to prevent too high a loss of the polar solvent in the raffinate due to increased solubility at the higher temperatures.

In conducting the solvent extraction, the volume ratio of the extraction solvent to the partially hydrogenated shale oil can vary within the range of between about 0.1:1 and about 10:1, but we prefer that a volume ratio of the two liquids of between about 0.5:1 and about 4:1 be used. The two liquids are contacted for sufficient time to permit a substantial solubilization of the nitrogenous compounds in the extraction solvent. The actual contact time that is involved depends upon a number of factors, including the temperature of the liquids, the degree of agitation and mixing, the actual composition of the extraction solvent, and the like; but generally a contact time within the broad range of about one to about 120 minutes can be used, but we prefer, for most extractions, that the contact time be within a range of about five to about 60 minutes.

The first-stage hydrogenation is carried out at conditions which are conventional for petroleum hydrogenation. This includes a temperature within the broad range of between about 600° F. and about 850° F., preferably between about 700° F. and about 800° F., and at a pressure between about 1,250 and about 2,500 psi, preferably between about 1,500 and about 2,000 psi. Any hydrogenation catalyst suitable for the hydrogenation of nitrogenous hydrocarbons can be used, such as a nickel hydrogenation catalyst. This includes nickel-molybdenum on alumina catalysts, nickel-cobalt on alumina catalysts, nickel-tungsten on silica-alumina catalysts, and the like.

The first-stage hydrogenation is carried out with the purpose, as indicated, of eliminating the more easily hydrogenated nitrogenous components so that only the more intractible nitrogenous components are left for solvent removal. In general, the second-stage solvent extraction stage will be utilized for the removal of between about 0.1 and about 50 percent of the total nitrogen removed by our process, preferably between about one and about 30 percent of the total nitrogen removed. Both nitrogen removal procedures are carried out to remove at least about 90 percent of the nitrogen desirably at least about 95 percent, preferably at least about 99 percent, and most preferably at least about 99.95 percent of the nitrogen.

The invention will be further described with reference to the following experimental work.

A crude, retorted Paraho shale oil was used in the following experiments. This crude shale oil analyzed 84.31 weight percent carbon, 11.45 percent hydrogen, 2.05 percent nitrogen, 1.2 percent oxygen and 0.68 percent sulfur.

EXAMPLE 1

The crude shale oil was partially hydrogenated to reduce the nitrogen level in a hydrogenation reactor at 2,108 psia and 729° F. using about 1,000 SCFB (cubic feet per barrel standardized to 60° F. and one atmosphere pressure) of hydrogen, in the presence of a nickel-molybdenum on alumina catalyst and at a liquid hourly space velocity (LHSV) of 1.0. The partially hydrogenated product was fractionated and a 400°–680° F. middle distillate cut was taken containing 0.53 percent nitrogen.

The nitrogen in this middle distillate fraction was removed in a multi-stage, continuous counter-current extractor using a liquid extractant consisting of 95.5 percent γ-butyrolactone, 1.67 percent HCl, and 2.83 percent water. The extraction was carried out at a temperature of about 95°–110° F. and a pressure of one atmosphere using a liquid extractant to middle distillate ratio of about 1:1. The denitrogenated oil was water washed to remove residual solvent and then dewatered by passing it through silica. The oil product was recovered in an 88 weight percent yield and analyzed seven ppm total nitrogen, of which five ppm was basic nitrogen. The stability of the denitrogenated oil was examined by ASTM D-381 and it was found that the existent gum was reduced from 11 mg/100 ml in the partially denitrogenated middle distillate to 1 mg/100 ml in the extracted oil product.

This two-stage denitrogenation using a partial hydrogenation followed by liquid extraction was compared with the total denitrogenation of the shale oil in one step by hydrogenation. The hydrogenation was carried out at a pressure of 2,226 psia and a temperature of 760° F. using 1,970 SCFB hydrogen at a LHSV of 0.5 using the same catalyst. The yield of denitrogenated oil was 98 percent. The product was fractionated and a 375°–650° F. cut was taken and analyzed. It was found to contain 21 ppm total nitrogen, of which 14 ppm was basic nitrogen. The existent gum was determined by ASTM D-381 to be 4 mg/100 ml.

EXAMPLES 2 and 3

Two samples of the Paraho crude shale were partially hydrogenated to different levels of nitrogen content. A middle distillate, 375°–650° F., cut was obtained from each partially hydrogenated sample, and each was treated with a liquid extractant in a single-stage batch contactor at 77° F. and one atmosphere. The solvent extractant contained 95 weight percent γ-butyrolactone, 1.87 percent HCl, and 3.13 percent water. The results are set out in Table I.

TABLE I

| Example | 2 | 3 |
|---|---|---|
| Extractant: oil, vol. ratio | 1:1 | 0.5:1 |
| Nitrogen content, ppm | | |
| 375–650° F. feed | | |
| total N | 2,000 | 369 |
| basic N | 1,700 | 290 |
| product | | |
| total N | 20 | 5 |
| basic N | <5 | <5 |
| Yield, wt % | 95 | 99 |

EXAMPLES 4–10

A series of extractions were conducted on several partially hydrogenated middle distillate fractions (375°–650° F.) and one partially hydrogenated whole range shale oil. The extractions were carried out in a single-stage, liquid-liquid equilibrium apparatus at a solvent-to-oil ratio of between 1:1 and 2:1, a temperature between 77° F. and 110° F. and at atmospheric pressure. The experiments compared extractions with the three-component solvent described herein with several simpler solvents. The results are set out in Table II.

TABLE II

| | | Solvent*, wt % | | | Raffinate | | |
|---|---|---|---|---|---|---|---|
| Ex. | N, ppm | Polar | Acid | $H_2O$ | N, ppm | Yield, % | Comment |
| 4 | 2,000 | 90 FA | 9 formic | 1 $H_2O$ | 60 | 95 | water-white |
| 5 | 369 | 79 MeOH | 13.1 $SO_2$ | 7.9 $H_2O$ | 70 | 98 | clear |
| 6 | 2,000 | 89 MeOH | 10 formic | 1 $H_2O$ | 110 | 96 | clear |
| 7 | 369 | — | 37 HCL | 63 $H_2O$ | 48 | 97 | sludge |
| 8 | 770 | 100 FA | — | — | 220 | 95 | clear |
| 9 | 770 | 100 BLO | — | — | 420 | 95 | clear |
| 10 | 7,100 | 100 BLO | — | — | 4,900 | 96 | — |

*FA is furfuryl alcohol
MeOH is methyl alcohol
BLO is γ-butyrolactone

In the following this two-stage procedure, the first-stage hydrogenation converts the major quantity of more-easily-hydrogenated, nitrogen compounds to more useful hydrocarbon compounds, which remain in the shale oils, while the nitrogen itself is eliminated from the oil. In the subsequent solvent removal procedure, which utilizes the three-component solvent described herein, the major quantity of the nitrogenous compounds which are more intractible to hydrogenation are removed from the system by the solvent. These compounds include a significant portion of the heterocyclic nitrogen compounds which are present in the shale oil or shale oil distillate.

After the extraction has been completed, the solvent solution can be separated from the extracted nitrogen compounds by distillation at reduced pressure. This solvent solution can be recycled for further use, together with make-up components, as an extractant. The nitrogenous fraction can be separated into its individual components for independent use, or the unseparated nitrogenous mixture can be used as a fuel or otherwise disposed of.

Our invention in its broadest sense involves the removal of nitrogen from a synthetic hydrocarbon shale oil by liquid-extraction using the multi-component extractant liquid, described above. The preferred procedure includes a preliminary partial hydrogenation before the liquid extraction to eliminate the more easily hydrogenated nitrogen compounds, as described above. The term "shale oil" is used herein in its broadest sense and is intended to include any shale oil or shale oil fraction which contains nitrogenous impurities. This includes crude shale oil, whether obtained by thermal retorting, solvent extraction, or by other means, shale oil which has been filtered for solids removal, or which has received one or more solvent, chemical, or other treatments and contains nitrogenous impurities, and includes any fractions of the shale oil whether obtained by distillation or other fractionation technique.

Our nitrogen removal procedure has been described above with particular reference to shale oil. However, it can also be successfully used for the removal of nitrogenous impurities from other synthetic hydrocarbon liquids, particularly those containing a significant quantity of cyclic, organic nitrogen compounds. This includes coal-derived oils, oils obtained from heavy tars and tar-sands, and the like.

It is to be understood that the above disclosure is by way of specific example and that numerous modifications and variations are available to those of ordinary skill in the art without departing from the true spirit and scope of the invention.

What is claimed as the invention:

1. The method for substantially eliminating nitrogen from a synthetic hydrocarbon oil which comprises the steps:

(a) subjecting the nitrogen compounds in a synthetic hydrocarbon oil to partial hydrogenation at suitable conditions for hydrogenation and in the presence of hydrogen and a hydrogenation catalyst whereby a substantial portion of the nitrogen compounds are hydrogenated, and (b) contacting the partially hydrogenated oil with a multi-component extractant solution comprising at least about 50 weight percent of an organic polar solvent selected from the group consisting of γ-butyrolactone and furfuryl alcohol, between about 0.5 and about 15 weight percent of a mineral acid or a carboxylic acid, and water in a weight ratio of water to said acid of up to about 10:1, whereby a substantial portion of the remaining nitrogen compounds are removed from the oil.

2. The method for substantially eliminating nitrogen from a synthetic hydrocarbon oil in accordance with claim 1 wherein said hydrogenation procedure removes between about 50 and about 99 percent of said nitrogen, said solvent extraction procedure removes between about one and about 50 percent of said nitrogen, and both procedures remove a total of at least about 90 percent of said nitrogen.

3. The method for substantially eliminating nitrogen from a synthetic hydrocarbon oil in accordance with claim 1 wherein said organic polar solvent comprising at least about 70 weight percent of said extractant solution, said acid comprises between about one and about ten weight percent of said extractant solution, and the weight ratio of water to acid in the extractant solution is between about 1:10 and about 1:1.

4. The method for substantially eliminating nitrogen from a synthetic hydrocarbon oil in accordance with claim 1 wherein said extractant solution is separated from the nitrogen compounds removed from the oil and is recycled for further use as an extractant solution.

5. The method for substantially eliminating nitrogen from a synthetic hydrocarbon oil in accordance with claim 1 wherein the synthetic hydrocarbon oil is shale oil.

6. The method for substantially eliminating nitrogen from a synthetic hydrocarbon oil in accordance with claim 1 wherein said mineral acid comprises hydrochloric acid, hypochlorous acid, sulfuric acid, sulfurous acid, sulfur dioxide, nitric acid, phosphoric acid, or phosphorous acid, and said carboxylic acid has from one to eighteen carbon atoms per molecule.

7. The method for substantially eliminating nitrogen from a synthetic hydrocabon oil which comprises the steps:

(a) subjecting the nitrogen compounds in a synthetic hydrocarbon oil to partial hydrogenation at suitable conditions for hydrogenation and in the presence of hydrogen and a hydrogenation catalyst whereby a substantial portion of the nitrogen compounds are hydrogenated, and (b) contacting the partially hydrogenated oil with a multi-component extractant solution comprising at least about 50 weight percent of $\gamma$-butyrolactone, between about 0.5 and about 15 weight percent of a mineral acid or a carboxylic acid, and water in a weight ratio of water to said acid of up to about 10:1, whereby a substantial portion of the remaining nitrogen compounds are removed from the oil.

8. The method for substantially eliminating nitrogen from a synthetic hydrocarbon oil in accordance with claim 1 wherein the acid is hydrogen chloride.

9. The method for substantially eliminating nitrogen from a synthetic hydrocarbon oil in accordance with claim 8 wherein said hydrogenation procedure removes between about 70 and about 99 percent of said nitrogen from the oil, said solvent extraction procedure removes between about one and about 30 weight percent of said nitrogen, and both procedures remove a total of at least about 99 percent of said nitrogen.

10. The method for substantially eliminating nitrogen from a synthetic hydrocarbon oil in accordance with claim 9 wherein both of said procedures remove a total of at least about 99.95 weight percent of said nitrogen.

* * * * *